US011377338B2

(12) United States Patent
Kaplita et al.

(10) Patent No.: US 11,377,338 B2
(45) Date of Patent: Jul. 5, 2022

(54) SELF-SERVE BEVERAGE DISPENSER

(71) Applicant: The Coca-Cola Company, Atlanta, GA (US)

(72) Inventors: Stan C. Kaplita, Sammamish, WA (US); Scott Cuppari, Peachtree City, GA (US); Douglas Jon McDougall, Atlanta, GA (US); Benjamin John Kingston, Suwanee, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 104 days.

(21) Appl. No.: 16/609,508

(22) PCT Filed: Apr. 30, 2018

(86) PCT No.: PCT/US2018/030151

§ 371 (c)(1),
(2) Date: Oct. 30, 2019

(87) PCT Pub. No.: WO2018/204240

PCT Pub. Date: Nov. 8, 2018

(65) Prior Publication Data

US 2020/0079637 A1 Mar. 12, 2020

Related U.S. Application Data

(60) Provisional application No. 62/492,605, filed on May 1, 2017.

(51) Int. Cl.
*B67D 1/00* (2006.01)
*B67D 1/08* (2006.01)

(52) U.S. Cl.
CPC ..... *B67D 1/0078* (2013.01); *B67D 1/0027* (2013.01); *B67D 1/0034* (2013.01);
(Continued)

(58) Field of Classification Search
CPC .. B67D 1/0078; B67D 1/0027; B67D 1/0034; B67D 1/0058; B67D 1/0857;
(Continued)

(56) References Cited

U.S. PATENT DOCUMENTS 2,194,775 A * 3/1940 Stadtfeld ..... B67D 1/0057 62/168
3,292,822 A * 12/1966 Crowder ..... G07F 13/065 222/129.1

(Continued)

FOREIGN PATENT DOCUMENTS

DE 34 17 005 A1 11/1985
DE 37 09 161 A1 10/1987

(Continued)

OTHER PUBLICATIONS

Extended Search Report, EP18794652.0, dated Nov. 12, 2020 (8 pp.).

(Continued)

*Primary Examiner* — Lien M Ngo
(74) *Attorney, Agent, or Firm* — Eversheds Sutherland (US) LLP

(57) ABSTRACT

The present application provides a beverage dispensing system. The beverage dispensing system may include a cooler and a beverage dispenser positioned within the cooler. The beverage dispenser may include a nozzle, a flow of water, an internal carbonation system in communication with the flow of water and the nozzle, and a number of internal ingredient containers in communication with the nozzle such that the beverage dispenser produces a beverage at the nozzle within the cooler.

14 Claims, 8 Drawing Sheets

(52) U.S. Cl.
CPC ..... *B67D 1/0058* (2013.01); *B67D 1/0857* (2013.01); *B67D 2210/00034* (2013.01)

(58) Field of Classification Search
CPC ..... B67D 1/0892; B67D 1/06; B67D 1/0057; B67D 2210/00034; B67D 2210/00031; B67D 2210/0827; B67D 2210/00036
USPC ..... 99/316, 323.1, 323.2, 279; 222/148, 222/129.1
See application file for complete search history.

(56) References Cited

U.S. PATENT DOCUMENTS 5,064,097 A * 11/1991 Brog ..... B01D 61/08 222/129
6,259,965 B1 7/2001 Steele et al.
7,044,335 B2 * 5/2006 Aguirre ..... B67D 1/0406 222/129.1
7,708,172 B2 * 5/2010 Crisp, III ..... B67D 1/08 222/399
9,630,826 B2 * 4/2017 Green ..... B67D 1/0884
9,933,203 B2 * 4/2018 An ..... B01F 23/236
2002/0083842 A1 * 7/2002 Kown ..... C02F 1/46104 99/290
2007/0034087 A1 2/2007 Colman et al.
2008/0093384 A1 * 4/2008 Fire ..... B67D 1/0412 222/144.5
2009/0069934 A1 * 3/2009 Newman ..... B67D 1/0021 700/239
2009/0293733 A1 * 12/2009 Martin ..... G07F 13/065 99/280
2010/0242497 A1 * 9/2010 Bertone ..... B67D 1/0053 62/1
2014/0209634 A1 * 7/2014 Metropulos ..... B67D 1/06 222/129.1
2014/0263406 A1 9/2014 Green et al.
2019/0330041 A1 * 10/2019 Fire ..... F25D 3/06

FOREIGN PATENT DOCUMENTS

EP 2 522 622 A1 11/2012
EP 2664880 A2 11/2013
WO 2015168293 A1 11/2015
WO 2017058259 A1 4/2017

OTHER PUBLICATIONS

International Search Report and Written Opinion, PCT/US2018/030151, dated Aug. 14, 2018 (11 pp.).

* cited by examiner

SELF-SERVE BEVERAGE DISPENSER

TECHNICAL FIELD

The present application and the resultant patent relate generally to a beverage dispenser and more particularly relate to an externally cooled beverage dispenser that provides a wide variety of customizable beverages in a small footprint sized for use on a cooler shelf.

BACKGROUND OF THE INVENTION

Current post-mix beverage dispensing systems generally mix streams of syrup, concentrate, sweetener, bonus flavors, other types of flavorings, and/or other ingredients with water or other types of diluents by flowing the syrup stream down the center of the nozzle with the water stream flowing around the outside. The syrup stream is directed downward with the water stream such that the streams mix as they fall into a consumer's cup. There is a desire for a beverage dispensing system as a whole to provide as many different types and flavors of beverages as may be possible in a footprint that may be as small as possible. Recent improvements in beverage dispensing technology have focused on the use of micro-ingredients. With micro-ingredients, the traditional beverage bases may be separated into their constituent parts at much higher dilution or reconstitution ratios.

This technology is enabled via cartridges containing the highly concentrated micro-ingredients. The micro-ingredients are mixed with sweeteners and still or sparkling water using precise metering and dosing technologies and dispensed through a nozzle that promotes in-air mixing so as to prevent carry-over. The technology includes a user input for a user to select a desired beverage, customize the beverage if desired, and pour the beverage at the dispenser. These beverages are made from precise recipes to ensure a great tasting beverage regardless of the customization. The beverage dispenser preferably may provide the consumer with multiple beverage options as well as the ability to customize the beverage as desired.

Although micro-ingredient technology has been successfully employed in retail outlets and other types of high volume locations, such micro-ingredients generally have not been applied in, for example, home applications or other types of low volume locations. Although, the micro-ingredients provide a wide variety of different beverage options, the potentially large number of micro-ingredient containers must be accounted for.

Current beverage dispensers generally include a cooling device to ensure that each beverage meets a chilled temperature standard. Such a beverage dispenser may include ice-cooled cold plates, mechanical refrigeration systems, ice baths, and the like. This infrastructure may be large and may take up space that otherwise could be used for items such as beverages in bottles or cans, other food items, or other items. For smaller food kiosks, small convenience stores, small retail shops, break rooms, and the like such beverage dispensers may require too much space to be placed within these venues. As such, these venues generally may be limited to coolers, refrigerators, or air current coolers, vending machines that store pre-mixed products for consumption. Furthermore, because such products may be limited to pre-mix products there is no ability for a customer to create a customized beverage. If customers were able to remove some of the pre-mixed bottles or cans there would be space available to offer a wider variety of consumable products.

SUMMARY OF THE INVENTION

The present application and the resultant patent thus provide a beverage dispensing system. The beverage dispensing system may include a cooler and a beverage dispenser positioned within the cooler. The beverage dispenser may include a nozzle, a flow of water, an internal carbonation system in communication with the flow of water and the nozzle, and a number of internal ingredient containers in communication with the nozzle such that the beverage dispenser produces a beverage at the nozzle within the cooler.

The present application and the resultant patent further provide a method of operating a beverage dispensing system. The method may include the steps of positioning a number of beverage ingredients and a source of carbon dioxide within a beverage dispenser without a refrigeration device, positioning the beverage dispenser within a cooler, flowing water to the beverage dispenser within the cooler, chilling the flow of water and the beverage ingredients in the beverage dispenser within the cooler, and creating a beverage within the cooler from the flow of water and the beverage ingredients.

The present application and the resultant patent further provide a beverage dispensing system. The beverage dispensing system may include a cooler and a beverage dispenser positioned within the cooler. The beverage dispenser may include a nozzle, a flow of water, an internal carbonation system in communication with the flow of water and the nozzle, and one or more internal macro-ingredient containers and a number of internal micro-ingredient containers in communication with the nozzle such that the beverage dispenser produces a beverage at the nozzle within the cooler from the flow of water, the one or more internal macro-ingredient containers, and the number of internal micro-ingredient containers.

These and other features and improvements of the present application and the resultant patent will become apparent to one of ordinary skill in the art upon review of the following detailed description when taken in conjunction with the shown drawings and the appended claims.

DETAILED DESCRIPTION

Figure 1:
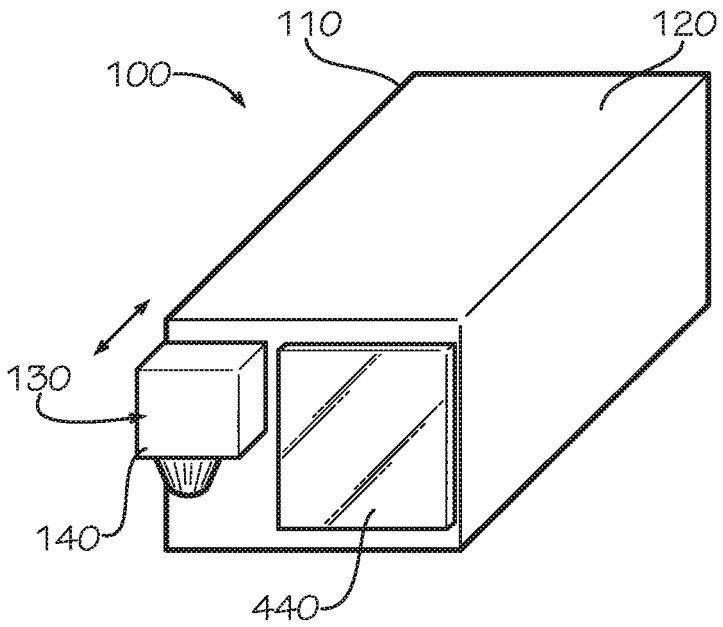
FIG. 1 is a perspective view of a beverage dispenser as may be described herein.
Figure 2:
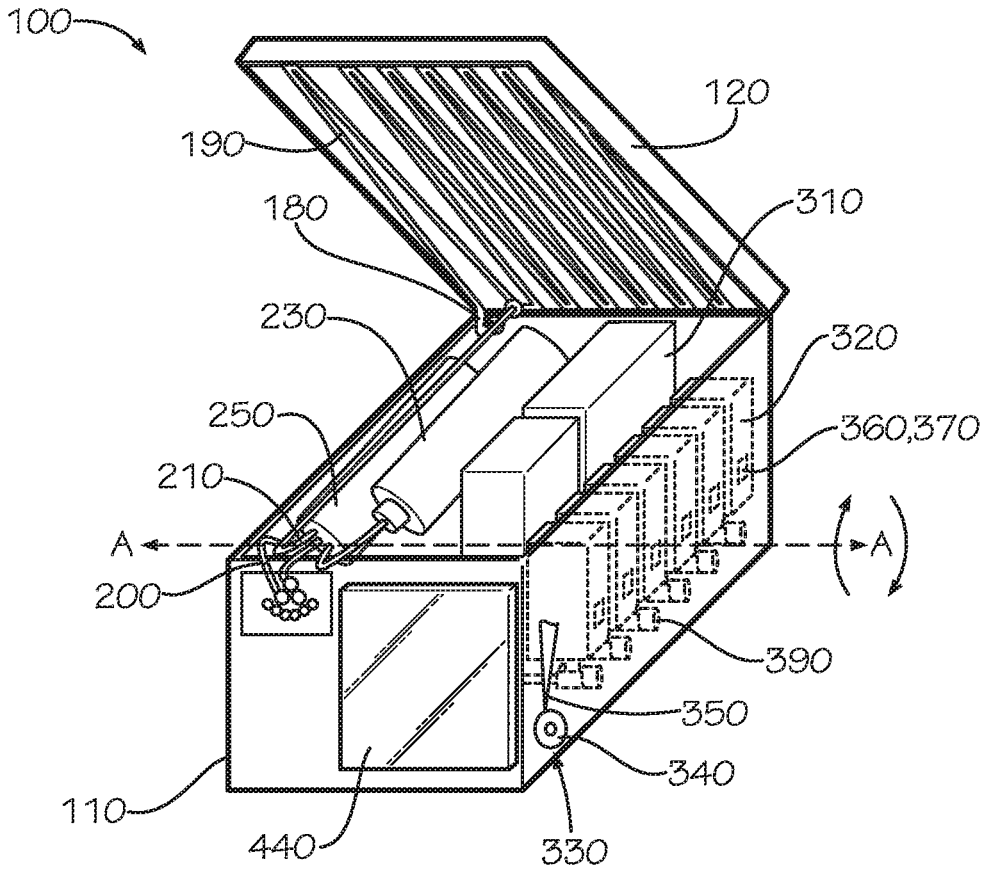
FIG. 2 is a schematic diagram of the internal components of the beverage dispenser of FIG. 1.

Referring now to the drawings, in which like numerals refer to like elements throughout the several views, FIG. 1 and FIG. 2 show an example of a beverage dispenser 100 as may be described herein. The beverage dispenser 100 may dispense many different types of beverages or other types of fluids. Specifically, the beverage dispenser 100 may be used with diluents, micro-ingredients, macro-ingredients, and other types of fluids. The diluents generally include plain water (still water or non-carbonated water), carbonated water, and other fluids.

Generally described, the macro-ingredients may have reconstitution ratios in the range from full strength (no dilution) to about six (6) to one (1) (but generally less than about ten (10) to one (1)). As used herein, the reconstitution ratio refers to the ratio of diluent (e.g., water or carbonated water) to beverage ingredient. Therefore, a macro-ingredient with a 5:1 reconstitution ratio refers to a macro-ingredient that is to be dispensed and mixed with five parts diluent for every part of the macro-ingredient in the finished beverage. Many macro-ingredients may have reconstitution ratios in the range of about 3:1 to 5.5:1, including 4.5:1, 4.75:1, 5:1, 5.25:1, 5.5:1, and 8:1 reconstitution ratios.

The macro-ingredients may include sweeteners such as sugar syrup, HFCS ("High Fructose Corn Syrup"), FIS ("Fully Inverted Sugar"), MIS ("Medium Inverted Sugar"), mid-calorie sweeteners comprised of nutritive and non-nutritive or high intensity sweetener blends, and other such nutritive sweeteners that are difficult to pump and accurately meter at concentrations greater than about 10:1—particularly after having been cooled to standard beverage dispensing temperatures of around 35-45° F. An erythritol sweetener may also be considered a macro-ingredient sweetener when used as the primary sweetener source for a beverage, though typically erythritol will be blended with other sweetener sources and used in solutions with higher reconstitution ratios such that it may be considered a micro-ingredient as described below.

The macro-ingredients may also include traditional BIB ("bag-in-box") flavored syrups (e.g., COCA-COLA bag-in-box syrup) which contains all of a finished beverage's sweetener, flavors, and acids that when dispensed is to be mixed with a diluent source such as plain or carbonated water in ratios of around 3:1 to 6:1 of diluent to the syrup. Other typical macro-ingredients may include concentrated extracts, purees, juice concentrates, dairy products, soy concentrates, and rice concentrates.

The macro-ingredient may also include macro-ingredient base products. Such macro-ingredient base products may include the sweetener as well as some common flavorings, acids, and other common components of a number of different finished beverages. However, one or more additional beverage ingredients (either micro-ingredients or macro-ingredients as described herein) other than the diluent are to be dispensed and mix with the macro-ingredient base product to produce a particular finished beverage. In other words, the macro-ingredient base product may be dispensed and mixed with a first micro-ingredient non-sweetener flavor component and a diluent to produce a first finished beverage. The same macro-ingredient base product may be dispense and mixed with a second micro-ingredient non-sweetener flavor component and a diluent to produce a second finished beverage. The viscosity of the macro-ingredients may range from about 1 to about 10,000 centipoise and generally over 100 centipoises or so when chilled. Other types of macro-ingredients may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. In some instances the viscosities of the micro-ingredients may be forty (40) centipoise or less. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of ingredients. Various acids may be used in micro-ingredients including food acid concentrates such as phosphoric acid, citric acid, malic acid, or any other such common food acids. Various types of alcohols may be used as either macro-ingredients or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

Typically, micro-ingredients for a finished beverage product include separately stored non-sweetener beverage component concentrates that constitute the flavor components of the finished beverage. Non-sweetener beverage component concentrates do not act as a primary sweetener source for the finished beverage and do not contain added sweeteners, though some non-sweetener beverage component concentrates may have sweet tasting flavor components or flavor components that are perceived as sweet in them. These non-sweetener beverage component concentrates may include the food acid concentrate and food acid-degradable (or non-acid) concentrate components of the flavor, such as described in commonly owned U.S. patent application Ser. No. 11/276,553, entitled "Methods and Apparatus for Making Compositions Comprising and Acid and Acid Degradable Component and/or Compositions Comprising a Plurality of Selectable Components." As noted above, the micro-ingredients may have reconstitution ratios ranging from about ten (10) to one (1) and higher, where the micro-ingredients for the separately stored non-sweetener beverage component concentrates that constitute the flavor components of the finished beverage typically have reconstitution ratios ranging from 50:1, 75:1, 100:1, 150:1, 300:1, or higher.

For example, the non-sweetener flavor components of a cola finished beverage may be provided from separately stored first non-sweetener beverage component concentrate and a second non-sweetener beverage component concentrate. The first non-sweetener beverage component concentrate may include the food acid concentrate components of the cola finished beverage, such as phosphoric acid. The second non-sweetener beverage component concentrate may include the food acid-degradable concentrate components of the cola finished beverage, such as flavor oils that would react with and impact the taste and shelf life of a non-sweetener beverage component concentrate were they to be stored with the phosphoric acid or other food acid concentrate components separately stored in the first non-sweetener component concentrate. Although the second non-sweetener beverage component concentrate does not include the food acid concentrate components of the first non-sweetener beverage component concentrate (e.g., phosphoric acid), the second non-sweetener beverage component concentrate still may be a high-acid beverage component solution (e.g., pH less than 4.6).

A finished beverage may have a number of non-sweetener concentrate components of the flavor other than the acid concentrate component of the finished beverage. For example, the non-sweetener flavor components of a cherry cola finished beverage may be provided from the separately stored non-sweetener beverage component concentrates described in the above example as well as a cherry non-sweetener component concentrate. The cherry non-sweetener component concentrate may be dispensed in an amount consistent with a recipe for the cherry cola finished beverage. Such a recipe may have more, less, or the same amount of the cherry non-sweetener component concentrate than other recipes for other finished beverages that include the cherry non-sweetener component concentrate. For example, the amount of cherry specified in the recipe for a cherry cola finished beverage may be more than the amount of cherry specified in the recipe for a cherry lemon-lime finished beverage to provide an optimal taste profile for each of the finished beverage versions. Such recipe-based flavor versions of finished beverages are to be contrasted with the addition of flavor additives or flavor shots as described below.

Other typical micro-ingredients for a finished beverage product may include micro-ingredient sweeteners. Micro-ingredient sweeteners may include high intensity sweeteners such as aspartame, Ace-K, steviol glycosides (e.g., Reb A, Reb M), sucralose, saccharin, or combinations thereof. Micro-ingredient sweeteners may also include erythritol when dispensed in combination with one or more other sweetener sources or when using blends of erythritol and one or more high intensity sweeteners as a single sweetener source.

Other typical micro-ingredients for supplementing a finished beverage product may include micro-ingredient flavor additives. Micro-ingredient flavor additives may include additional flavor options that can be added to a base beverage flavor. The micro-ingredient flavor additives may be non-sweetener beverage component concentrates. For example, a base beverage may be a cola flavored beverage, whereas cherry, lime, lemon, orange, and the like may be added to the cola beverage as flavor additives, sometimes referred to as flavor shots. In contrast to recipe-based flavor versions of finished beverages, the amount of micro-ingredient flavor additive added to supplement a finished beverage may be consistent among different finished beverages. For example, the amount of cherry non-sweetener component concentrate included as a flavor additive or flavor shot in a cola finished beverage may be the same as the amount of cherry non-sweetener component concentrate included as a flavor additive or flavor shot in a lemon-lime finished beverage. Additionally, whereas a recipe-based flavor version of a finished beverage is selectable via a single finished beverage selection icon or button (e.g., cherry cola icon/button), a flavor additive or flavor shot is a supplemental selection in addition to the finished beverage selection icon or button (e.g., cola icon/button selection followed by a cherry icon/button selection).

In the traditional BIB flavored syrup delivery of a finished beverage, a macro-ingredient flavored syrup that contains all of a finished beverage's sweetener, flavors, and acids is mixed with a diluent source such as plain or carbonated water in ratios of around 3:1 to 6:1 of diluent to the syrup. In contrast, for a micro-ingredient delivery of a finished beverage, the sweetener(s) and the non-sweetener beverage component concentrates of the finished beverage are all separately stored and mixed together about a nozzle when the finished beverage is dispensed. Example nozzles suitable for dispensing of such micro-ingredients include those described in commonly owned U.S. provisional patent application Ser. No. 62/433,886, entitled "Dispensing Nozzle Assembly," PCT patent application Serial No. PCT/US15/026657, entitled "Common Dispensing Nozzle Assembly," U.S. Pat. No. 7,866,509, entitled "Dispensing Nozzle Assembly," or U.S. Pat. No. 7,578,415, entitled "Dispensing Nozzle Assembly."

In operation, the beverage dispenser may dispense finished beverages from any one or more of the macro-ingredient or micro-ingredient sources described above. For example, similar to the traditional BIB flavored syrup delivery of a finished beverage, a macro-ingredient flavored syrup may be dispensed with a diluent source such as plain or carbonated water to produce a finished beverage. Additionally, the traditional BIB flavored syrup may be dispensed with the diluent and one or more micro-ingredient flavor additives to increase the variety of beverages offered by the existing beverage dispenser.

Micro-ingredient-based finished beverages may be dispensed by separately dispensing each of the two or more non-sweetener beverage component concentrates of the finished beverage along with a sweetener and diluent. The sweetener may be a macro-ingredient sweetener or a micro-ingredient sweetener and the diluent may be water or carbonated water. For example, a micro-ingredient-based cola finished beverage may be dispensed by separately dispensing a food acid concentrate components of the cola finished beverage, such as phosphoric acid, food acid-degradable concentrate components of the cola finished beverage, such as flavor oils, macro-ingredient sweetener, such as HFCS, and carbonated water. In another example, a micro-ingredient-based diet-cola finished beverage may be dispensed by separately dispensing a food acid concentrate components of the diet-cola finished beverage, food acid-degradable concentrate components of the diet-cola finished beverage, micro-ingredient sweetener, such as aspartame or an aspartame blend, and carbonated water. As a further example, a mid-calorie micro-ingredient-based cola finished beverage may be dispensed by separately dispensing a food acid concentrate components of the mid-calorie cola finished beverage, food acid-degradable concentrate components of the mid-calorie cola finished beverage, a reduced amount of a macro-ingredient sweetener, a reduced amount of a micro-ingredient sweetener, and carbonated water. By reduced amount of macro-ingredient and micro-ingredient sweeteners, it is meant to be in comparison with the amount of macro-ingredient or micro-ingredient sweetener used in the cola finished beverage and diet-cola finished beverage. As a final example, a supplemental flavored micro-ingredient-based beverage, such as a cherry cola beverage or a cola beverage with an orange flavor shot, may be dispensed by separately dispensing a food acid concentrate components of the flavored cola finished beverage, food acid-degradable concentrate components of the flavored cola finished beverage, one or more non-sweetener micro-ingredient flavor additives (dispensed as either as a recipe-based flavor version of a finished beverage or a flavor shot), a sweetener (macro-ingredient sweetener, micro-ingredient sweetener, or combinations thereof), and carbonated water. Although the above examples are provided for carbonated beverages, they apply to still beverages as well by substituting carbonated water with plain water.

The various ingredients may be dispensed by the beverage dispenser in a continuous pour mode where the appropriate ingredients in the appropriate proportions (e.g., in a predetermined ratio) for a given flow rate of the beverage being dispensed. In other words, as opposed to a conventional batch operation where a predetermined amount of ingredients are combined, the beverage dispenser provides for continuous mixing and flows in the correct ratio of ingredients for a pour of any volume. This continuous mix and flow method can also be applied to the dispensing of a particular size beverage selected by the selection of a beverage size button by setting a predetermined dispensing time for each size of beverage.

The beverage dispenser 100 may include an outer shell 110. The outer shell 110 may have any suitable size, shape, or configuration. As will be described in more detail below, the beverage dispenser 100 and the outer shell 110 may be sized to be positioned within a conventional refrigerator, cooler, or any type of refrigerated device. The outer shell 110 may be enclosed by an access door 120. The access door 120 may have any suitable size, shape, or configuration. The access door 120 may be opened to allow access within the outer shell 110. The outer shell 110 and the access door 120 may be made in whole or in part out of thermoplastics, stainless steel, or any material that promotes good heat transfer therethrough.

Figure 3A:
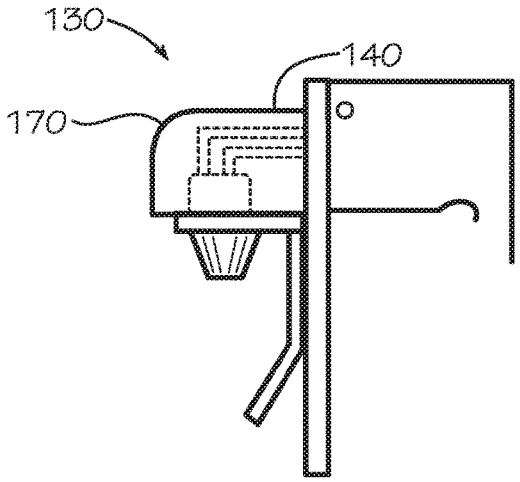
FIG. 3A is a schematic diagram of a nozzle for use in the beverage dispenser of FIG. 1 in a retracted position.
Figure 3B:
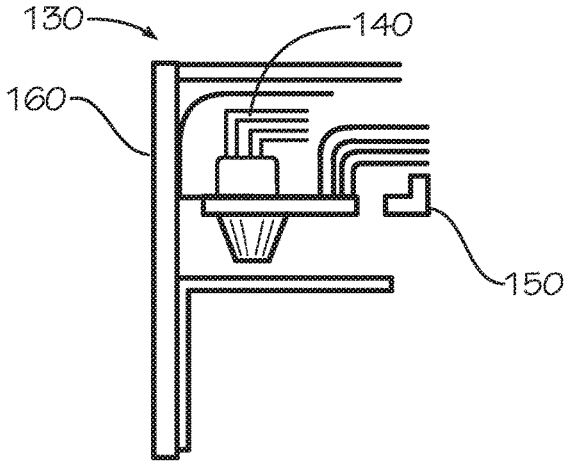
FIG. 3B is a schematic diagram of the nozzle for use in the beverage dispenser of FIG. 1 in an extended position.

The beverage dispenser 100 may include a nozzle 130 positioned about the outer shell 110. The nozzle 130 may be a multi-flavor air-mix nozzle such as those described above and may have any suitable, size, shape, or configuration. As is shown in FIGS. 3A and 3B, the nozzle 130 may be a pop-out nozzle 140. The pop-out nozzle 140 may be positioned for in and out movement about a nozzle frame 150. The pop-out nozzle 140 may be a retracted position 160 as shown in FIG. 3A when not in use and in an extended position 170 as shown in FIG. 3B when in use. The retracted position 160 frees up additional space about the beverage dispenser 100 when not in use for a reduced overall foot print. The pop-out nozzle 140 may maneuver in and out along the nozzle frame 150 in a conventional manner including manually, electro-mechanically, pneumatically, and via other types of drive mechanisms. Other components and other configurations may be used herein.

The beverage dispenser 100 may include one or more water sources 180 in communication with the nozzle 130. Other types of diluents may be used herein. In this example, the nozzle 130 may be in communication with the water source 130 via an incoming water line 190. The incoming water line 190 may have any suitable length. As is shown in FIG. 2, the incoming water line 190 may have any number of turns or coils so as to increase the amount of time that the flow of water from the water source 180 may be in the refrigerated space. Alternatively, a more direct path may be used if the water source 180 itself is refrigerated in whole or in part.

Figure 4:
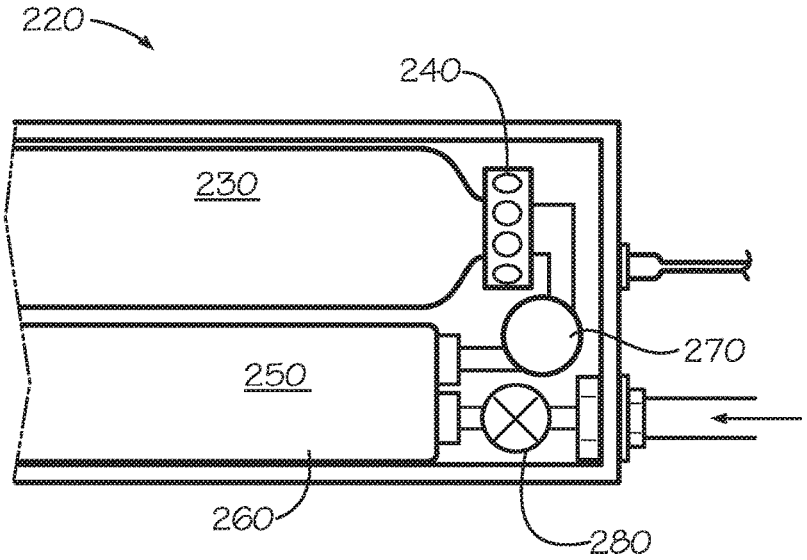
FIG. 4 is a schematic diagram of a carbonation system for use in the beverage dispenser of FIG. 1.

The incoming water line 190 may branch into a still water line 200 in communication with the nozzle 130 and into a carbonated water line 210 in communication with a carbonation system 220. As is shown in FIG. 4, the carbonation system 220 may include a carbon dioxide tank 230. The carbon dioxide tank 230 may have any suitable size, shape, or configuration. The carbon dioxide tank 230 may be a standard food grade DOT approved tank and the like. The carbon dioxide tank 230 may be replaceable via a standard twist-on interface 240 and the like. Other sources of carbon dioxide may be used. The carbonation system 220 also may include a carbonator 250. The carbonator 240 may be a carbonator tank 260 or an in-line carbonator also may be used. Other types of carbonators 250 such as a hollow fiber carbonator or other types of devices that may harvest carbon dioxide from the air also may be used herein. The carbonator 250 may have any suitable size, shape, or configuration. The flow of carbon dioxide from the carbon dioxide tank 230 may be controlled by a regulator 270. The regulator 270 may be of conventional design. The flow of water to the carbonator 250 may be controlled by one or more pumps 280. The pumps 280 may be of conventional design any may include nutating pumps, positive displacement pumps, and the like. The carbon dioxide may dissolve within in the water in the carbonator 250 and the resulting carbonated water may flow to the nozzle 130. Other components and other configurations may be used herein.

The beverage dispenser 100 may include any number of ingredient containers 300. Different types and sizes of ingredient containers 300 may be used herein for the differing ingredients. For example, the ingredient containers 300 may include a number of macro-ingredient containers 310 with macro-ingredients such as those described above. Specifically, the macro-ingredient containers 310 may include macro-ingredients such as sweeteners and other types of beverage bases. The ingredient containers 300 also may include a number of micro-ingredient containers 320 with micro-ingredients such as those described above. Specifically, the micro-ingredients containers 320 may include micro-ingredients such as highly concentrated beverage ingredients and flavors. Generally described, the macro-ingredient containers 310 may be larger than the micro-ingredient containers 320 although more micro-ingredient containers 320 may be used than macro-ingredient 310 containers. Alternatively, all of the ingredient containers 310 may have the same size, shape, or configuration. The ingredient containers 300 may be made out of any type of substantially rigid, food grade materials in whole or in part. Other types of containers and other ingredients may be used herein.

Because some of the micro-ingredients may require agitation, some or all of the micro-ingredient containers 320 may be positioned on a micro-ingredient rack 330. The micro-ingredient rack 330 may be driven by an agitation motor 340 via a cam 350 or other types of linkages. The agitation motor 340 may be any type of drive device suitable for transmitting pivoting, reciprocating, or other types of agitating motion to the micro-ingredient rack 330 and the micro-ingredients therein. The agitation motor 340 may operate continuously or periodically. Other components and other configurations may be used herein.

Given the potential for a significant number of different types of micro-ingredients that may be used, the beverage dispenser 100 may have an RFID reader 360 therein while the micro-ingredient containers 320 may have an RFID tag 370. The RFID reader 360 and the RFID tags 370 may be of conventional design. The RFID reader 360 may identify the RFID tag 370 on a given micro-ingredient container 320, direct the appropriate placement of the micro-ingredient container 320 on the micro-ingredient rack 330, ensure that the correct micro-ingredient containers 320 are installed therein, identify empty micro-ingredient containers 320, and provide other types of information. Other types of identification and communication devices and systems may be used herein. Given the limited number of macro-ingredient containers 310 that may be used, the macro-ingredient containers 310 may or may not have an RFID tag 370 thereon. Other components and other configurations may be used herein.

Figure 5:
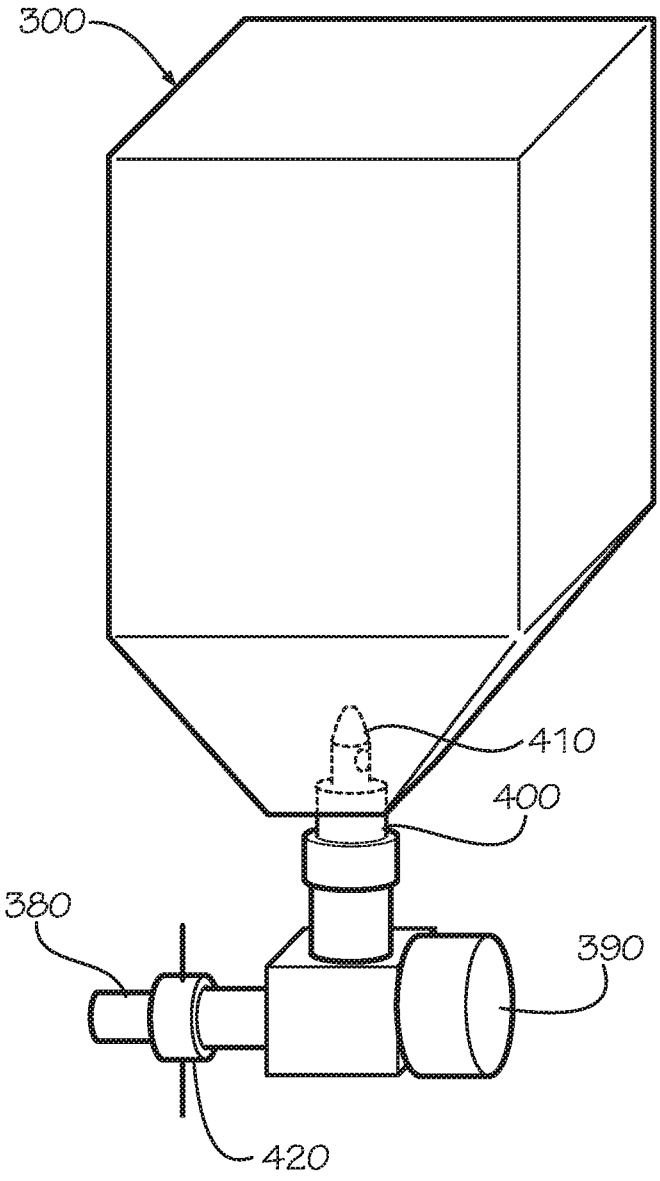
FIG. 5 is a schematic diagram of an ingredient cartridge for use in the beverage dispenser of FIG. 1.
Figure 6:
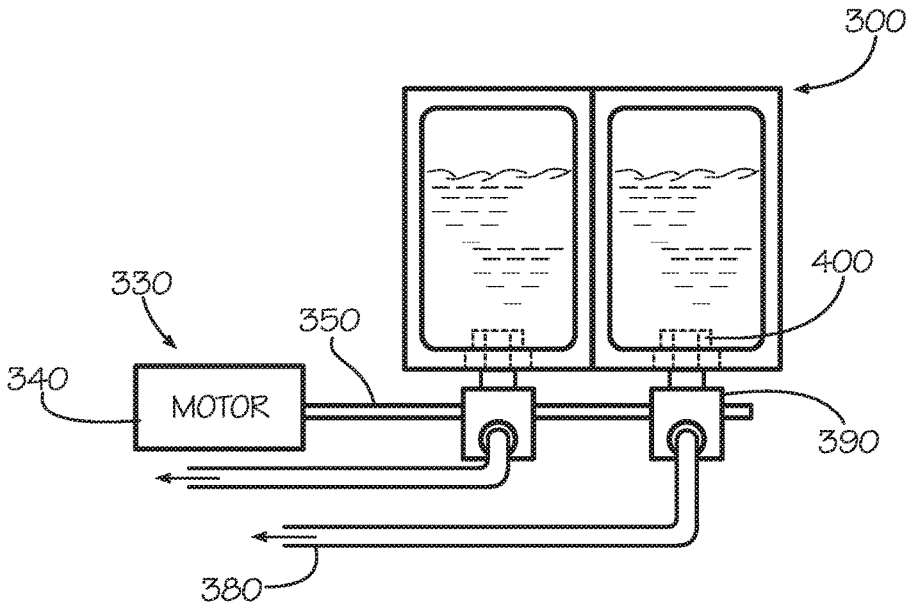
FIG. 6 is a schematic diagram of a micro-ingredient rack and motor for use in the beverage dispenser of FIG. 1.

As is shown in FIGS. 5 and 6, the ingredient containers 300 may be in communication with the nozzle 130 via a number of ingredient lines 380 and ingredient pumps 390. Different types of pumps 390 may be used due to the nature of the different ingredients. The micro-ingredients may use, for example, a positive displacement pump such as a piston pump, a nutating pump, a gear pump, an annular pump, a peristaltic pump, a piezo pump, and the like. The macro-ingredients may use, for example, a controlled gear pump, a pneumatic pump, and the like. One pump 390 may be in communication with a number of ingredient containers 300. Other types of pumps 390 may be used herein. The ingredients lines 380 or the pumps 390 may be in communication with the ingredient containers 300 via a fitment 490 and the like thereon. The fitment 490 may have a check valve 410 and the like thereon to control the flow rate therethrough and to prevent a reverse flow. The fitments 490 and the check valves 410 may be of conventional design. Sold out probes 420 and the like also may be used in communication with each or some of the ingredient containers 300. The sold out probes may be of conventional design. Other components and other configurations may be used herein.

Figure 7:
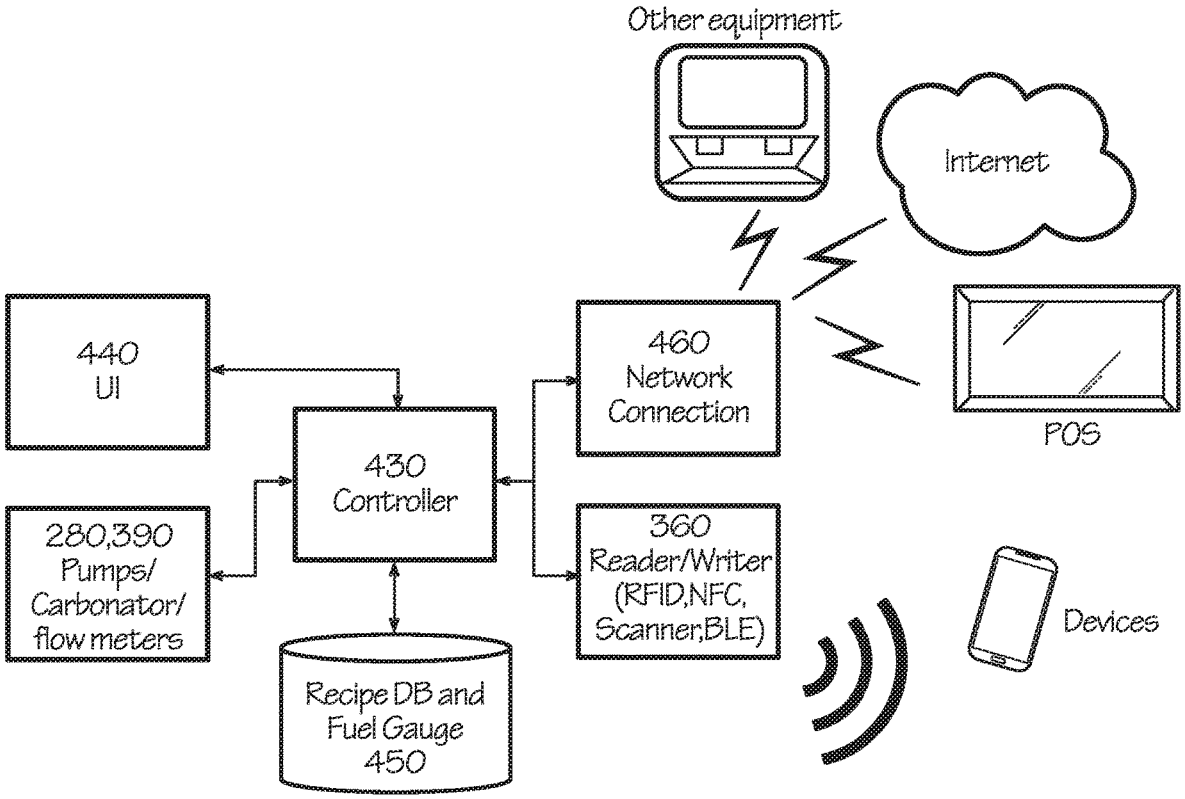
FIG. 7 is a system block diagram of the control architecture and network connectivity of the beverage dispenser of FIG. 1.

Operation of the beverage dispenser 100 may be governed by a controller 430. The controller 430 may be any type of programmable logic device. The controller 430 may be local or remote. Multiple controllers 430 may be used herein. As is shown in FIG. 7, the controller 430 may be in communication with conventional input devices, memory, operating systems, and communication systems so as to provide the desired functionality.

For example, beverage selections may be made through a touchscreen user interface 440 or other typical beverage user interface selection mechanism (e.g., buttons). The selected beverage, including any selected flavor additives, may be dispensed upon the beverage dispenser 100 receiving a further dispense command through a separate dispense button on the touchscreen user interface or through interaction with a separate pour mechanism such as a pour button (electromechanical, capacitive touch, or otherwise) or pour lever. A conventional database 450 may contain beverage recipes with respect to ingredients, flow rates, and other parameters. The database 450 also may contain ingredient container 300 fill levels, i.e., a fuel gauge, and the like via interaction between the controller 430 and the RFID reader 360 and RFID tags 370. A conventional network connection 460 may be in communication with the Internet, point of sale devices, other types of dispensing equipment, and the like. The controller 430 also may be in communication with a local payment device and/or a wireless payment system. Other components and other configurations may be used herein.

In response to a request for a beverage received on the touchscreen user interface 440 or otherwise, the controller 430 may determine the recipe of the requested beverage from the database 450 and may instruct the appropriate pumps 280, 390 to operate in the appropriate manner. Specifically, the controller 430 may initiate the appropriate pumps 390 for a macro-ingredient and a number of micro-ingredients and the appropriate pump 280 for a water flow or other diluent. The macro-ingredient, the micro-ingredients, and the water thus may be mixed at the nozzle 130 to create the appropriate beverage.

The beverage dispenser 100 also may provide status information, sales information, and the like to a centralized operational center and the like. Additional ingredient containers 300, carbonation tanks 230, and other types of dispensing ingredients and equipment also may be automatically ordered depending upon determined fill levels, ingredient shelf lives, and other parameters. Service calls also may be initiated as required. Other types of information and parameters also may be used herein. Other components and other configurations may be used herein.

Figure 8:
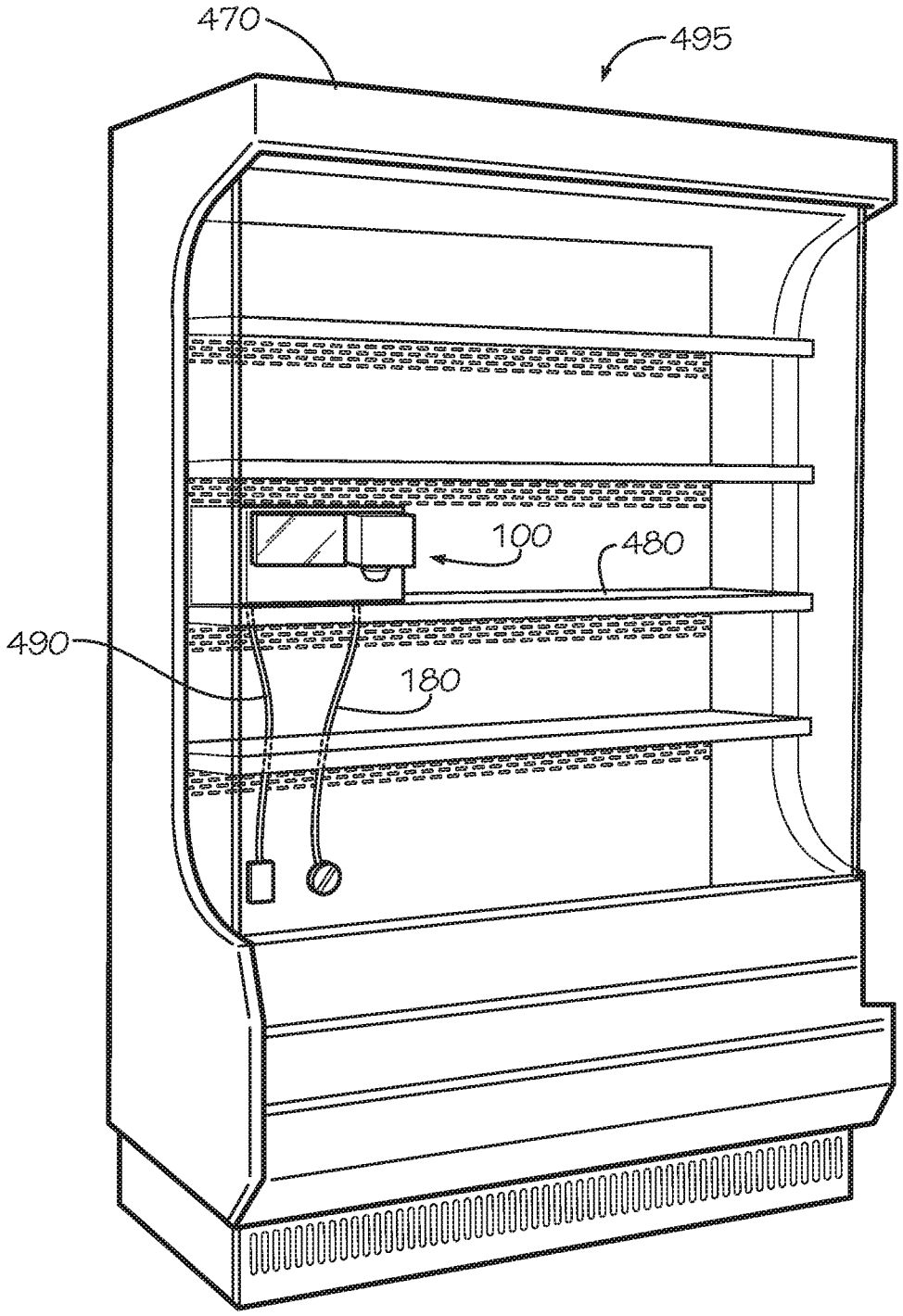
FIG. 8 is a perspective view of an exemplary beverage dispensing system as may be described herein with the beverage dispenser of FIG. 1 positioned within a cooler.
Figure 9:
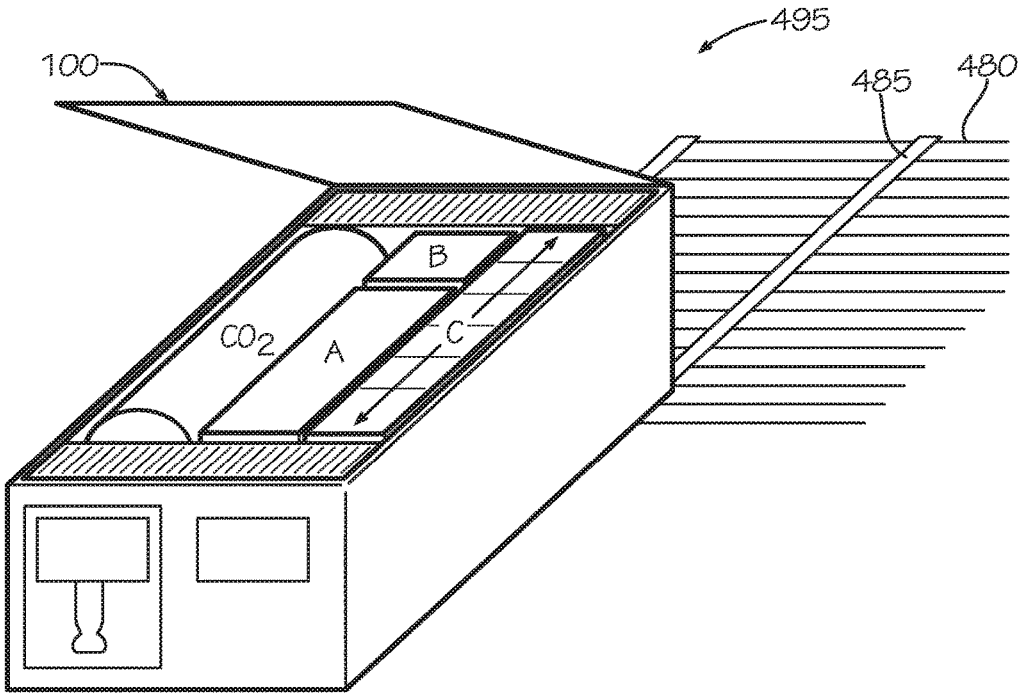
FIG. 9 is a schematic diagram of the beverage dispenser of FIG. 1 sliding along a rack on a cooler shelf.

FIGS. 8 and 9 show the positioning of the beverage dispenser 100 within a cooler 470. As described above, the cooler 470 may be any type of cooling device of any size, shape, configuration, or capacity. Heating devices also may be used herein. The beverage dispenser 100 may be positioned on a shelf 480 therein. Any type of support surface may be used herein. As is shown in FIG. 8, a sliding track 485 may be used to maneuver the beverage dispenser 100 in and out of the shelf 485 so as to, for example, replace the ingredient container 300 and/or the carbon dioxide tank 230. Once installed within the cooler 470, the beverage dispenser 100 may be connected to the water source 180 and an electrical source 490. As described above, refrigeration of the beverage dispenser 100 and the ingredients therein is provided by the cooler 470 itself. The combination of the beverage dispenser 100 and the cooler 470 may be considered a beverage dispensing system 495. An industry standard interface with the water supply and the electrical supply may be provided by cooler original equipment manufacturers. Alternatively, a retrofit interface also may be used herein. Other components and other configurations may be used herein.

Figure 10:
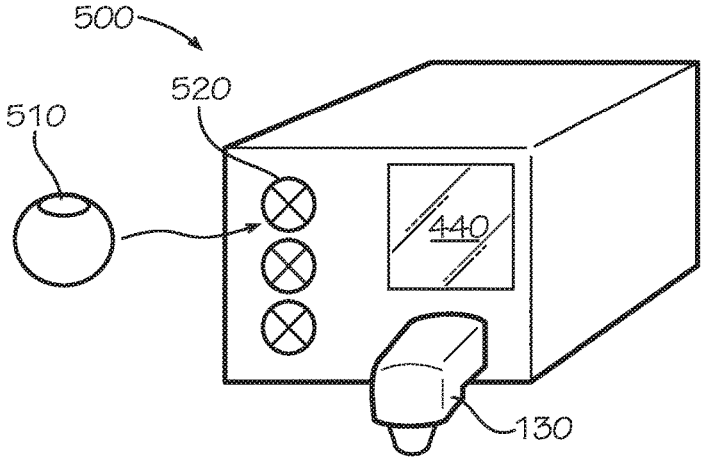
FIG. 10 is a schematic diagram of an alternative embodiment of a beverage dispenser that may be described herein for use with ingredient pods.
Figure 11:
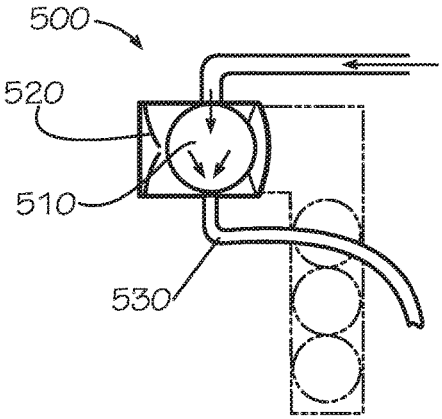
FIG. 11 is a partial side sectional view of the beverage dispenser of FIG. 10.

FIGS. 10 and 11 show a further embodiment of a beverage dispenser 500 as may be described herein. Instead of or in addition to the use of the ingredient containers 300 described above, the beverage dispenser 500 may be configured to accept any number of ingredient pods 510. The pods 510 may have any suitable size, shape, or configuration. The pods 510 may be made out of thermoplastics and the like. The pods 510 may contain any type of ingredient such as macro-ingredients or micro-ingredients as described above. The ingredients may contain beverage brands, sweeteners, flavors, and the like. For example, the pods 510 may create a customized beverage by combining a number of pods with ginger, vitamin C, acai sparkling water, and cran-lime flavor. The possible combinations of ingredients are unlimited.

In order to accommodate the pods 510, the outer shell 110 of the beverage dispenser may have one or more pod bays 520. Each pod bay 520 may be in communication with the incoming water line 190 with the flow of water and in communication with the nozzle 130 via a pod ingredient line 530. A user may push a pod 510 into the pod bay 520. Doing so may push a previous pod 510 out of the bay 520 or the user may remove the previous pod 510. The user may use the user interface touchscreen 440 to select other ingredients or to customize a finish pod product, i.e., sweetness, carbonation, and the like. Other components and other configurations may be used herein.

Figure 12:
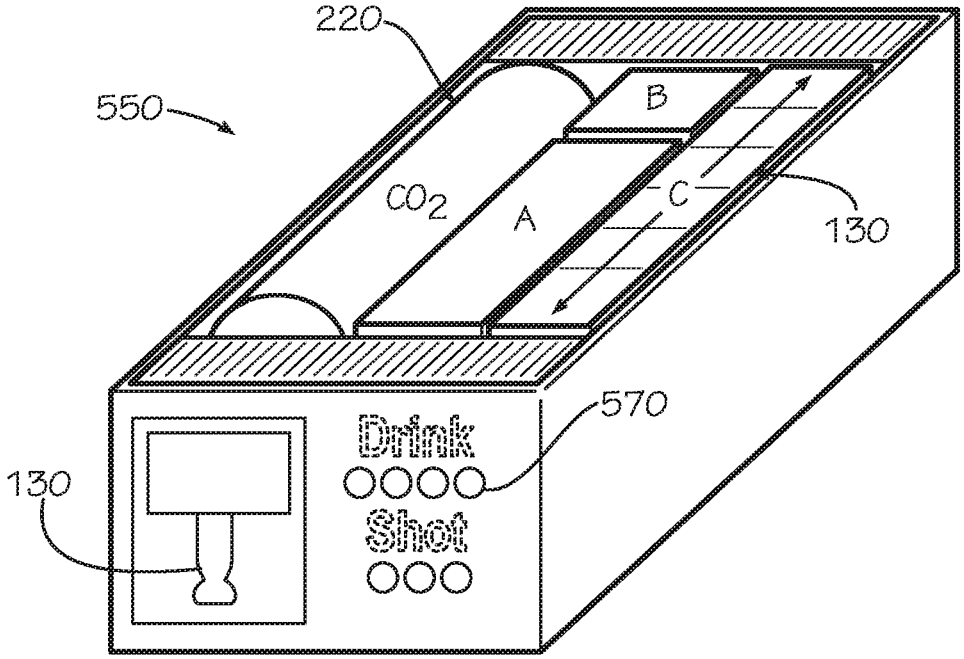
FIG. 12 is a schematic diagram of an alternative embodiment of a beverage dispenser as may be described herein using a mechanical pump.
Figure 13:
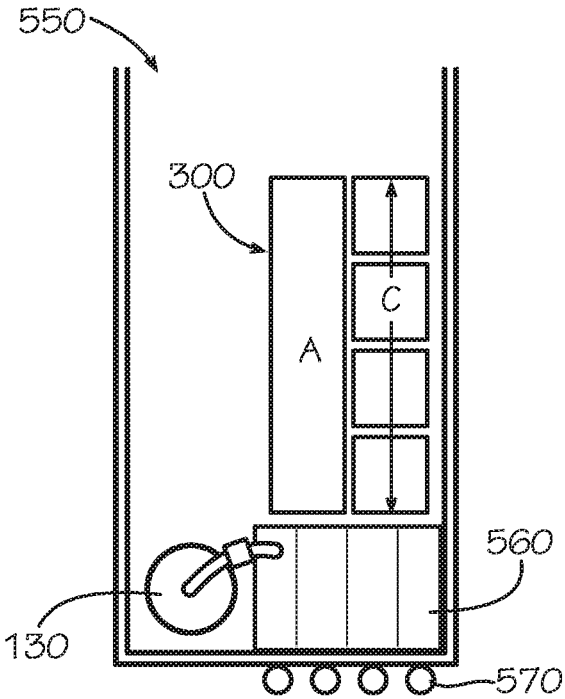
FIG. 13 is a top plan view of the beverage dispenser of FIG. 12.
Figure 14:
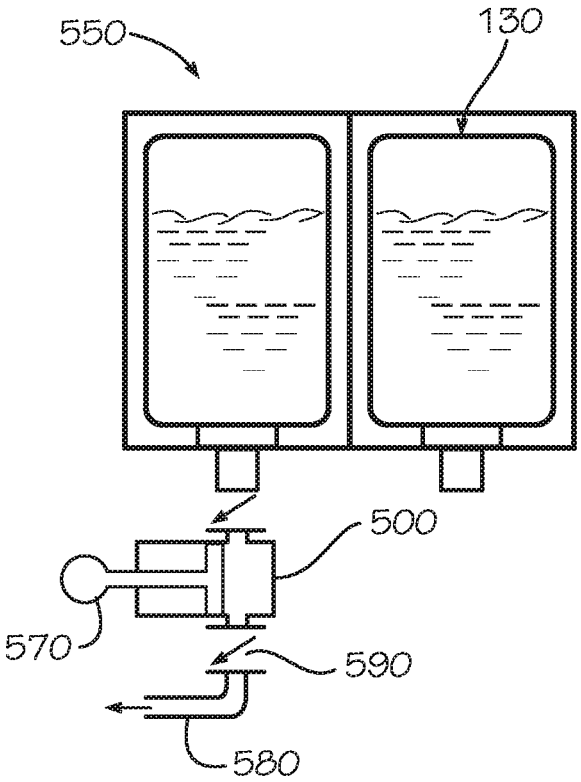
FIG. 14 is a partial side sectional view of the beverage dispenser of FIG. 12.

FIGS. 12, 13, and 14 show a further embodiment of a beverage dispenser 550 as may be described herein. The beverage dispenser 550 may be a mechanical device without the need for electrical components or motors in whole or in part. The ingredient containers 300, individually or collectively, may be in communication with a mechanical volume displacement pump 560 or other type of manually operated pump. A mechanical lever 570 and the like may extend outside of the outer shell 110. A user may maneuver the lever 570 to dispense a beverage, a flavor, and the like via a mechanical line 580 in communication with the nozzle 130. A check valve 590 and the like may be positioned on the mechanical line 580. The use of one or multiple levers 570 may be required to create the desired beverage. Each mechanical volume displacement pump 560 may be in communication with one or more ingredient containers 300. The pods 510 and the like also may be used herein. Other components and other configurations may be used herein.

Figure 15A:
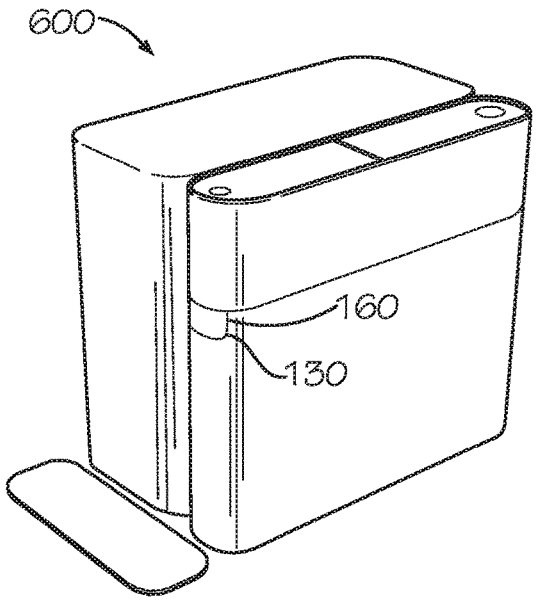
FIG. 15A is a perspective view of an alternative embodiment of a beverage dispenser as may be described herein with the nozzle in the retracted position.
Figure 15B:
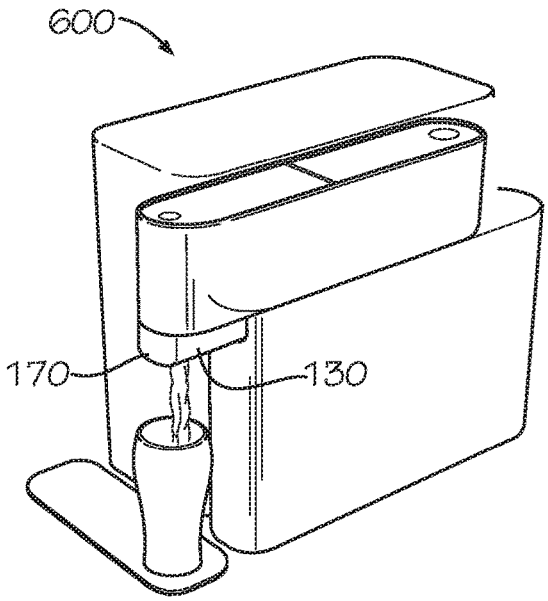
FIG. 15B is a perspective view of the beverage dispenser of FIG. 15A with the nozzle in the extended position.

FIGS. 15A and 15B show a possible commercial embodiment of a beverage dispenser 600 as may be described herein. FIG. 15A shows the pop out nozzle 140 in the retracted position 160. FIG. 15B shows the pop out nozzle 140 in the extended position 170. In this example, the outer shell 110 may be made out of stainless steel in whole or in part. Other components and other configurations may be used herein.

Figure 16:
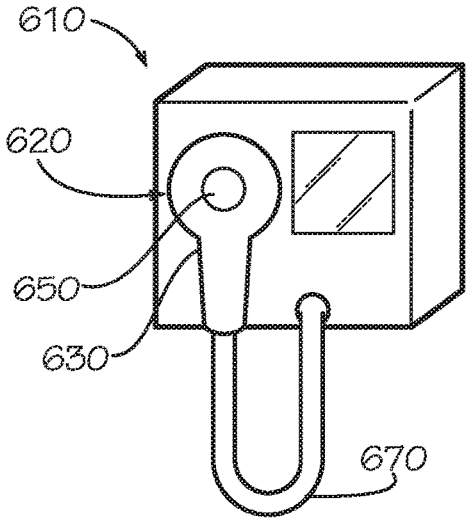
FIG. 16 is a perspective view an alternative embodiment of a beverage dispenser as may be described herein using bar gun.
Figure 17:
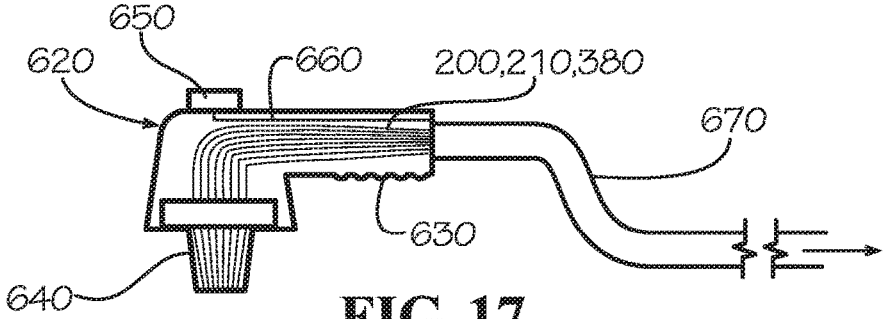
FIG. 17 is a partial sectional view of the bar gun of FIG. 16.

FIGS. 16 and 17 show a further example of a beverage dispenser 610 as may be described herein. Instead of the use of the fixed nozzle 130 as described above, the beverage dispenser 610 may use a bar gun 620. The bar gun 620 may include a handle 630 with the ingredient lines 380 and the water lines 200, 210 therein. The ingredient lines 380 and the water lines 200, 210 may lead to a gun nozzle 640. An actuator 650 positioned on the handle 630 may activate the bar gun 620 via a control line 660 in communication with the controller 430. The ingredient lines 380 and the water lines 200, 210 may be in communication with the outer shell 110 by a python 670. The python 670 may have any suitable length. Other types of flexible extending nozzles may be used herein. Other components and other configurations may be used herein.

The beverage dispensers described herein thus provide any number of different beverages in a compact footprint intended to be placed within a conventional cooler. The beverage dispenser provides such a compact footprint by avoiding the need for a dedicated refrigeration system and, in certain embodiments, dedicated electronics. Such simplification also results in lower acquisition costs and overall operating costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A beverage dispensing system for producing a beverage, comprising:
- a cooler; and
- a beverage dispenser positioned within the cooler;
- the beverage dispenser comprising:
- a nozzle;
- a flow of water;
- an internal carbonation system in communication with the flow of water and the nozzle;
- a plurality of internal ingredient containers in communication with the nozzle; and
- an outer shell;
- wherein the internal carbonation system and the plurality of internal micro-ingredient containers are positioned within the outer shell and wherein the nozzle is positioned about the outer shell;
- an agitating micro-ingredient rack with the plurality of internal micro-ingredient containers thereon; and
- wherein the beverage dispenser produces the beverage at the nozzle within the cooler.

2. The beverage dispensing system of claim 1, wherein the nozzle comprises a pop out nozzle with a retracted position and an extended position.

3. The beverage dispensing system of claim 2, wherein the pop out nozzle comprises a nozzle frame for movement thereon.

4. The beverage dispensing system of claim 1, wherein the flow of water comprises a still water line in communication with the nozzle and a carbonated water line in communication with the internal carbonation system.

5. The beverage dispensing system of claim 1, wherein the internal carbonation system comprises a carbon dioxide tank in communication with a carbonator.

6. The beverage dispensing system of claim 5, wherein the carbonator comprises a carbonation tank or an in-line carbonator.

7. The beverage dispensing system of claim 1, further comprising one or more macro-ingredient containers.

8. The beverage dispensing system of claim 1, further comprising an RFID reader and wherein one or more of the plurality of internal micro-ingredient containers comprise an RFID tag thereon.

9. The beverage dispensing system of claim 1, further comprising one or more pumps in communication with the plurality of internal micro-ingredient containers and the nozzle.

10. The beverage dispensing system of claim 9, wherein the one or more pumps comprise positive displacement pumps or mechanical pumps.

11. The beverage dispensing system of claim 1, wherein the plurality of internal micro-ingredient containers comprises a plurality of ingredient pods.

12. A beverage dispensing system for producing a beverage, comprising:
- a cooler; and
- a beverage dispenser positioned within the cooler;
- the beverage dispenser comprising:
- a nozzle;
- a flow of water;
- an internal carbonation system in communication with the flow of water and the nozzle;
- a plurality of internal ingredient containers in communication with the nozzle; and an outer shell;

wherein the internal carbonation system and the plurality of internal ingredient containers are positioned within the outer shell and wherein the nozzle is positioned about the outer shell;

wherein the beverage dispenser produces the beverage at the nozzle within the cooler; and wherein the cooler comprises a shelf with a track and wherein the beverage dispenser is maneuverable along the track.

13. A method of operating a beverage dispensing system, comprising:

positioning a plurality of beverage ingredients and a source of carbon dioxide within an outer shell of a beverage dispenser without a refrigeration device;

positioning the beverage dispenser on a shelf with a track within a cooler;

wherein the beverage dispenser is maneuverable along the track;

flowing water to the beverage dispenser within the cooler;

chilling the flow of water and the plurality of beverage ingredients in the beverage dispenser within the cooler; and creating a beverage within the cooler from the flow of water and the plurality of beverage ingredients.

14. The beverage dispensing system of claim 1, wherein the cooler comprises an electrical cooler.

* * * * *